US005295569A

United States Patent [19]

Kubota

[11] Patent Number: 5,295,569

[45] Date of Patent: Mar. 22, 1994

[54] ESCALATOR DEVICE

[76] Inventor: Masao Kubota, 22-7, Narimasu 2-chome, Itabashi-ku, Tokyo, 175, Japan

[21] Appl. No.: 915,723

[22] PCT Filed: Nov. 30, 1991

[86] PCT No.: PCT/JP91/01679

§ 371 Date: Jul. 28, 1992

§ 102(e) Date: Jul. 28, 1992

[87] PCT Pub. No.: WO92/09519

PCT Pub. Date: Jun. 11, 1992

[30] Foreign Application Priority Data

Nov. 30, 1990 [JP] Japan ..... 2-330367

[51] Int. Cl.[5] ..... B66B 23/12

[52] U.S. Cl. ..... 198/333

[58] Field of Search ..... 198/333, 321, 326

[56] References Cited

U.S. PATENT DOCUMENTS

| | | | |
|---|---|---|---|
| 4,557,369 | 12/1985 | Ishida et al. | 198/333 |
| 4,569,433 | 2/1986 | Ishida et al. | 198/333 |
| 4,681,207 | 7/1987 | Goto et al. | 198/333 |
| 5,024,314 | 6/1991 | Kitamura et al. | 198/333 |
| 5,062,519 | 11/1991 | Haruta | 198/333 |

FOREIGN PATENT DOCUMENTS

| | | | |
|---|---|---|---|
| 0132335 | 1/1985 | European Pat. Off. . | |
| 2719394 | 11/1978 | Fed. Rep. of Germany | 198/333 |
| 3431610 | 3/1985 | Fed. Rep. of Germany . | |
| 61-28768 | 2/1986 | Japan . | |
| 61-28287 | 12/1986 | Japan . | |
| 0008190 | 1/1990 | Japan | 198/333 |
| 2-13594 | 1/1990 | Japan . | |
| 3-098991 | 4/1991 | Japan | 198/333 |
| 0166192 | 7/1991 | Japan | 198/333 |

OTHER PUBLICATIONS

Patent Abstracts of Japan, vol. 14, No. 152, (M-0953), Mar. 23, 1990.

*Primary Examiner*—Cheryl L. Gastineau
*Attorney, Agent, or Firm*—Staas & Halsey

[57] ABSTRACT

Escalator steps for loading a wheelchair or the like comprise a set of three serial steps (1), (2), and (3). Steps (1) and (3) are positioned at the front and rear of an intermediate step (2). Step (1) comprises fixed step (10) and floating step (11) and step (3) comprises fixed step (30) and floating step (31). Floating steps 11 and 31 are capable of being separated from fixed steps (1) and (3), respectively. When an escalator is traveling under a normal condition, fixed steps (1) and (3) and floating steps (11) and (31) are integrally coupled to each other for enabling the escalator to operate as a common escalator. When loading a wheelchair on the steps, however, floating step (11) and (31) are coupled with intermediate step (2), whereby intermediate step (2) and floating steps (11) and (31) form a level tread capable of loading the wheelchair.

4 Claims, 7 Drawing Sheets

ESCALATOR DEVICE

TECHNICAL FIELD

The present invention relates to an escalator device capable of loading a wheelchair, a long object or the like, and in particular, to an escalator device characterized by a simple structure and easy operation.

BACKGROUND ART

Various inventions have been made concerning escalator devices for loading a wheelchair or long objects. According to such inventions, however, a level tread is formed with two identical step treads, which are joined to each other using a means such as a fork, jack, screw or the like. Further, when there is enough space to load the wheelchair or the like, a method characterized by inclining a third step tread is adopted. Except in the case of a fixed coupling method, according to a method in which a step tread can be kept in the same state as that of a common step which travels under a normal condition, the structure and operation thereof are complicated and expensive. In addition, according to the fixed coupling method, the structure can be made simple, but travelling under the normal condition is not so comfortable. Besides, the radius of rotation becomes large at the rotating portion. As a result, there is such a disadvantage that the size of the device increases.

DISCLOSURE OF THE INVENTION

An object of the present invention is to provide a escalator device, which travels in the same state as that of a usual steps when travelling for ordinary purpose and forms step having a level tread for loading the wheelchair or the like on the three steps adjacent to each other when loading the wheelchair, long object or the like on the escalator device.

Another object of the present invention is to provide an escalator device, which is capable of loading the wheelchair or the like without inviting complication of structure and increase in the size.

In order to achieve the objects mentioned above, the escalator device according to the present invention comprises a set of three serial steps consisting of an intermediate step, a front step and a rear step, of which each of the front step and the rear step is divided into a fixed step and a floating step; a first coupling means for coupling the intermediate step to each of the floating steps; a second coupling means for coupling the floating steps and the corresponding fixed steps; and a means for associating the first coupling means and the second coupling means with each other, wherein the second coupling means functions as a changing means for releasing the coupling of the respective floating steps and the corresponding fixed steps when the intermediate step is coupled with the respective floating steps by the first coupling means.

Preferably, the first coupling means includes reciprocating supporting members for coupling the intermediate step and each of the floating steps, which can be extended in front and rear directions and horizontal or upward inclined directions from the intermediate step but also can be inserted in each of the front and rear floating steps, whereas the second coupling means includes transverse direction supporting members which can be inserted in each of fixed steps corresponding to each of the floating steps.

Preferably, the changing means includes a pinion arranged in the intermediate step, a rack positioned for being movable to a position for engaging with the pinion on a floor where steps of the escalator device become level, a crank mechanism for moving the reciprocating supporting members by a rotation of the pinion, a mechanism for starting and stopping the rotation of a crankshaft by a rotational angle of 180° in association with engagement of the rack and pinion, and a pinion and rack mechanism for moving the transverse supporting members in association with movement of the reciprocating supporting members.

More preferably, a car stop mechanism for preventing the wheelchair or the like from falling is provided in the steps for loading the wheelchair or the like, having the level tread formed by coupling the intermediate step and the front and rear floating steps. The car stop mechanism is arranged in the floating step which positioned downward from the intermediate step so that it can freely project when the escalator is in an inclined traveling process and includes a means for projecting the car stop from the floating step when the intermediate step and each of the floating steps are coupled by the first coupling means, and the level tread is then formed by the coupling of the intermediate step and each of the floating steps.

As mentioned above, according to the present invention, when each of floating steps and the corresponding fixed steps are coupled by the second coupling means, the coupled fixed and floating steps move forming a single step and constitute a normal escalator device. Further, when the intermediate step and each of floating steps are coupled by the first coupling means, the intermediate step and each of the floating steps are moved forming the level tread capable of loading the wheelchair, long object or the like thereon.

Preferably, when the escalator is in the inclined traveling process, the car stop is projected from the floating step which positioned downward from the intermediate step so as to prevent the loaded wheelchair or the like from falling.

BRIEF DESCRIPTION OF THE DRAWINGS

FIG. 10 is a diagram explaining the relationship between coupling/separation of steps and the in-and-out of the car stop corresponding to operation for loading or bringing down the wheelchair or the like.

BEST MODE OF CARRYING OUT THE INVENTION

Figure 1:
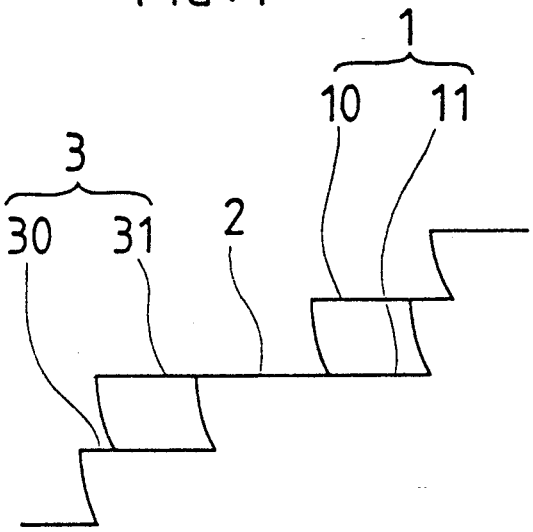
FIG. 1 is a side view showing a state of steps for loading a wheelchair or the like in an inclined traveling process of an escalator device according to an embodiment of the present invention.
Figure 2:
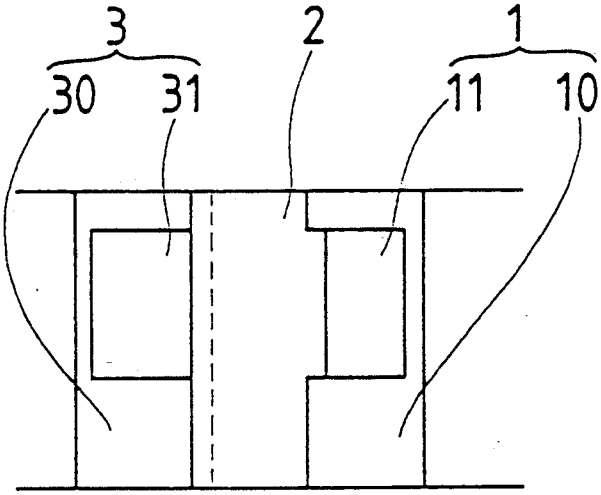
FIG. 2 is a plan view of FIG. 1.

An outline of an escalator device according to an embodiment of the present invention will be first described with reference to FIGS. 1 and 2.

Steps for loading a wheelchair comprises a set of three serial steps 1, 2, and 3. Of the three steps, a step 1 positioned in front of an intermediate step 2 is divided into a front floating step 11 and a front fixed step 10 not including the floating step 11. Further, a step 3 positioned in the rear of the intermediate step 2 is divided into a rear floating step 31 and a rear fixed step 30 not including the floating step 31. The escalator device of the present embodiment travels in a state in which the front floating step 11 and the front fixed step 10 are integrally coupled with each other to form a level step tread in a normal condition and the rear floating step 31 and the rear step 30 are also coupled with each other in the same manner.

On the other hand, when loading the wheelchair or the like on the steps of the escalator device, the coupling of the front floating step 11 and the front fixed step 10 and of the rear floating step 31 and the rear fixed step 30 are released respectively so that the front floating step 11 and the rear floating step 31 are coupled with the intermediate step 2. Thus, as shown in FIG. 1, the front and rear floating steps 11 and 31 constitute a horizontal step tread flush with a step tread of the intermediate step 2 to permit the wheelchair or the like to be loaded thereon for carriage.

A mechanism of the steps (three serial steps) for loading the wheelchair or the like according to the present embodiment will be described hereinafter with reference to FIGS. 3 through 9.

Figure 3:
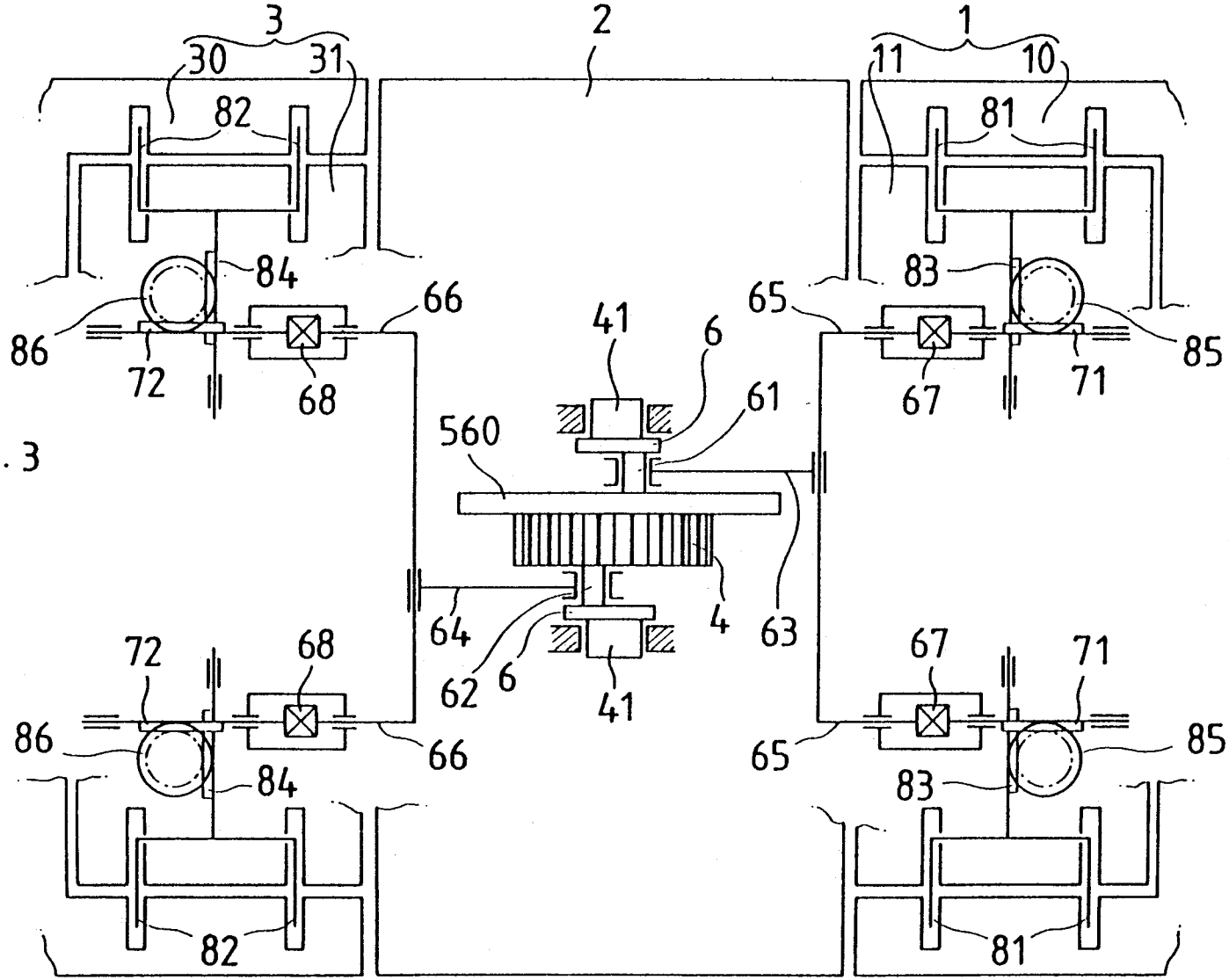
FIG. 3 is a plan view showing a mechanism for carrying out a formation and release of the steps for loading the wheelchair in the escalator device according to the embodiment of the present invention.
Figure 4:
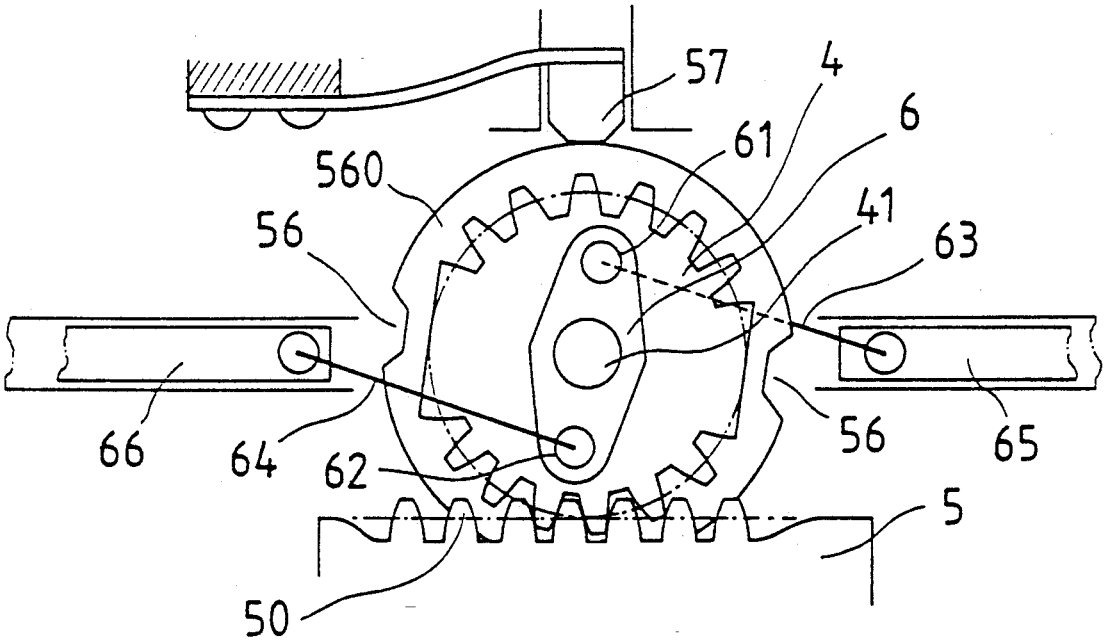
FIG. 4 is a partial front view showing a driving pinion and a crank mechanism of FIG. 3.

FIG. 3 is a plan view of the mechanism showing a state of just before the escalator device stops in order to load the wheelchair or the like on the three serial steps, and FIG. 4 is a partial plan view showing a state in which the escalator device is traveling in a normal condition (when the steps for loading the wheelchair or the like are not formed). The front step 1, intermediate step 2 and rear step 3 are designed to form a single unit of step when loading the wheelchair or the like. The front step 1 comprises the front floating step 11 and the front fixed step 10 not including the floating step 11, whereas the rear step 3 comprises the rear floating step 31 and the rear fixed step 30 not including the floating step 31. The intermediate step 2 includes a pinion 4, which functions as a means for changing the coupling between the front and rear floating steps 11 and 31 and the intermediate step 2 or between the fixed steps 10 and 30 and the intermediate step 2. A circular disc 560 having grooves 56 of a click mechanism is fixed on the pinion. A pawl 57 to engage with the grooves 56 is provided in the intermediate step 2 via a spring. A crankshaft 6 is attached to a pinion shaft 41. Crank pins 61 and 62, whose phases differ by an angle of 180° from each other, are attached to the crankshaft 6. Coupling rods 63 and 64 are rotatably connected to the crank pins 61 and 62 respectively. Reciprocating supporting members 65 and 66 function as a coupling means for coupling the intermediate step 2 and the front and rear floating steps 11 and 31 and are pivotably connected to the coupling rods 63 and 64 respectively. When the pinion 4 rotates, the reciprocating supporting members 65 and 66 reciprocate in association with the crankshaft 6 and the coupling rods 63 and 64.

Figure 5:
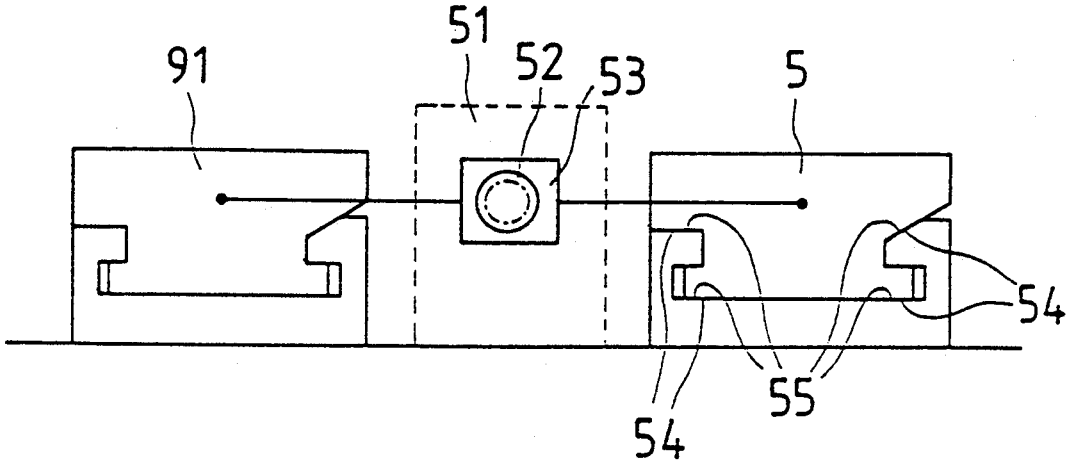
FIG. 5 is a plan view of a mechanism for moving a driving rack for a floor side to an engaging position in the escalator device according to the embodiment of the present invention.
Figure 6:
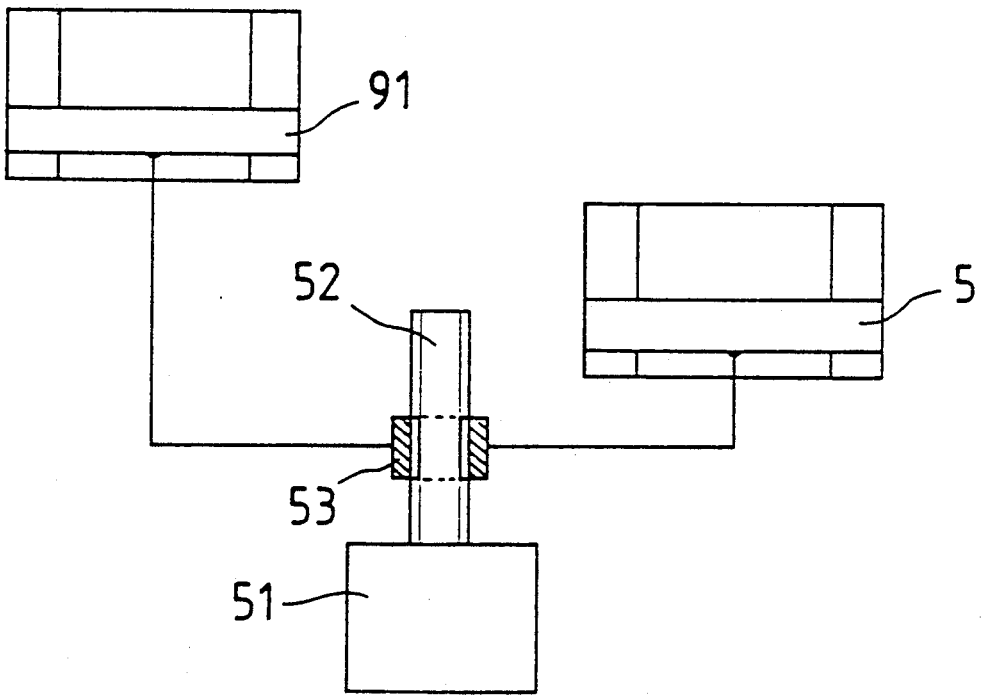
FIG. 6 is a side view of FIG. 5.

The pinion 4 engages with a floor side rack 5 which has been moved to an engaging position. There are two kinds of mechanism for moving the rack 5 from a retreat position to the engaging position: one is a mechanism for moving the rack horizontally toward the pinion shaft 41, and the other a mechanism for moving the rack vertically relative to the pinion shaft 41. In the present embodiment, as shown in FIGS. 5 and 6, adopted is a mechanism for moving the rack horizontally to the engaging position along the direction of the pinion shaft 41 by means of a feeding mechanism comprising a screw 52 rotating by a motor 51, which is secured on a floor, and a nut 53 fixed on the rack 5. Incidentally, reference numerals 54 and 55 respectively indicate floor-side and rack-side horizontal guiding surfaces. In this mechanism, the length of a pitch line 50 of the rack 5 is preset to a length slightly shorter than a length equivalent to ½ of the circumference of the pitch circle of the pinion 4 so that, when an engagement of the pinion 4 with the rack 5 is completed by being rotated up to 180° according to inertia force, the pawl 57 is fitted into the groove 56 of the click mechanism to stop the rotation of the pinion.

As seen from FIGS. 3 and 4, distal ends of the reciprocating supporting members 65 and 66, which constitute the connection means of the intermediate step 2 and the floating steps 11 and 31, are connected to racks 71 and 72 by means of detachable joints 67 and 68 respectively, and the racks 71 and 72 engage with both of racks 83 and 84, which are provided on transverse supporting members 81 and 82, and pinions 85 and 86 respectively. The transverse supporting members 81 and 82, racks 83 and 84, pinions 85 and 86 or the like constitute the coupling means for coupling the floating steps 11 and 31 and the corresponding fixed steps 10 and 30.

When the reciprocating supporting members 65 and 66 move forward (motion from the center toward the outside direction in FIG. 3) causing the racks 71 and 72 to move forward, pinions 85 and 86 rotate, causing transverse supporting members 81 and 82 to move backward and the resulting respective disengagement from engaging grooves of the front and rear fixed steps 10 and 30. As a result, coupling of the front floating step 11 and the front fixed step 10 and of the rear floating step 31 and the rear fixed step 30 is released, respectively. Furthermore, when the reciprocating supporting members 65 and 66 move forward and the respective coupling of the front floating step 11 and the front fixed step 10 and of the rear floating step 31 and the rear fixed step 30 is released, the intermediate step 2 and the front and rear floating steps 11 and 31 are integrally coupled with each other by means of the detachable joints 67 and 68 positioned between the reciprocating supporting members 65 and 66 and the floating steps 11 and 31, whereby the front and rear floating steps 11 and 31 move together with the intermediate step 2 forming a level step tread that permit the loading of the wheelchair of the like on the formed surface for carriage.

Conversely, when the racks 61 and 72 move backward in association with the backward movement of the reciprocating supporting members 65 and 66, the pinions 85 and 85 rotate in the reverse direction, causing transverse supporting members 81 and 82 to move forward to fit into the engaging grooves of the front and rear fixed steps 10 and 30 (a state such as shown in FIG. 3). Thus, the front and rear floating steps 11 and 31 are coupled with the front and rear fixed steps 10 and 30, respectively.

Moreover, the reciprocating supporting members 65 and 66 are respectively released from the detachable joints 67 and 68 during their backward movement and drawn into the intermediate step 2. Thus, when disengaged from the intermediate step 2, the front and rear floating steps 11 and 31 are coupled with the front and rear steps 10 and 30 respectively. Therefore, the front and rear floating steps 11 and 31 are caused to move together with the front and rear fixed steps 10 and 30 respectively, so that a normal operation of the escalator device can be effected.

Figure 7:
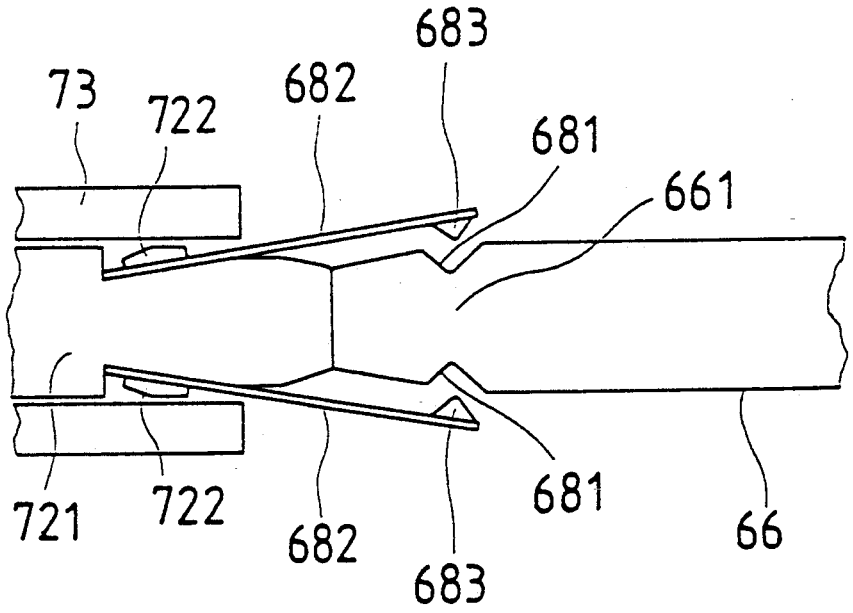
FIG. 7 is a side view of a mechanical-type detachable joint used in the escalator device according to the embodiment of the present invention.

Although a magnetic clutch utilizing the opening and closing effects of an electromagnetic circuit may be adopted for the detachable joints 67 and 68, it is preferably to use a simple mechanical joint such as those shown in FIG. 7. The detachable joints 67 and 68 are of an identical structure respectively, so that an example of the detachable joint 68 attached to the distal end of the reciprocating supporting member 66 is illustrated. A neck 661 having oblique faces 681 is formed at the distal end of the reciprocating supporting member 66, and a pair of levers 682, which extend obliquely and have projections corresponding with the oblique faces 681, are mounted on a blank end 721 of the rack 72 by means of pins 722 so that such pair of lever can freely be opened or closed. Further, when the lever 682 closes, the connected point between the reciprocating supporting member 66 and the blank end of the rack 72 is received within a sleeve 73 in a state in which the surfaces of the projections provided to the distal end of the lever are in contact with the oblique faces 681. The reciprocating supporting member 66 functions as a joint in the sleeve 73; however, when the member 66 moves toward the right direction in FIGS. 3 and 7, and the jointed portion (the connected portion between the reciprocating supporting member 66 and the blank end 721) is drawn out from the sleeve 73, the lever 682 opens, and the engagement of the projections 683 and the oblique faces 681 is released, and thus the joint of the reciprocating supporting member 66 and the rack 72 is released. As shown in FIG. 7, the pair of levers 682 also function as a spring to ensure an opening action, so that the reversion of the rack 72 can effectively be prevented.

Figure 8:
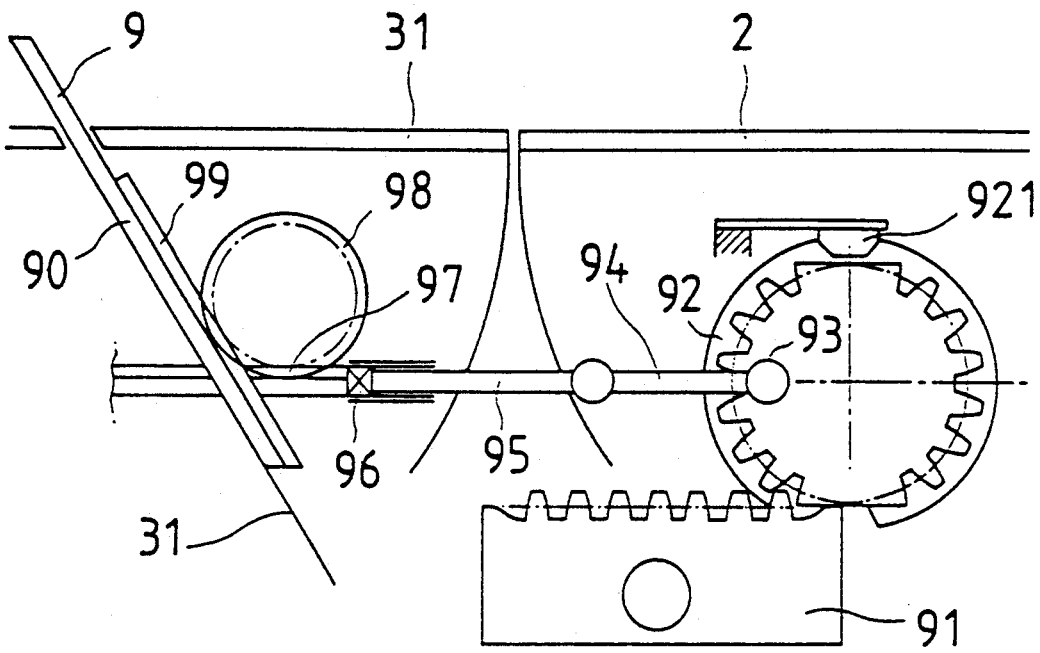
FIG. 8 is a side view of a car stop mechanism in the escalator device according to the embodiment of the present invention.
Figure 9:
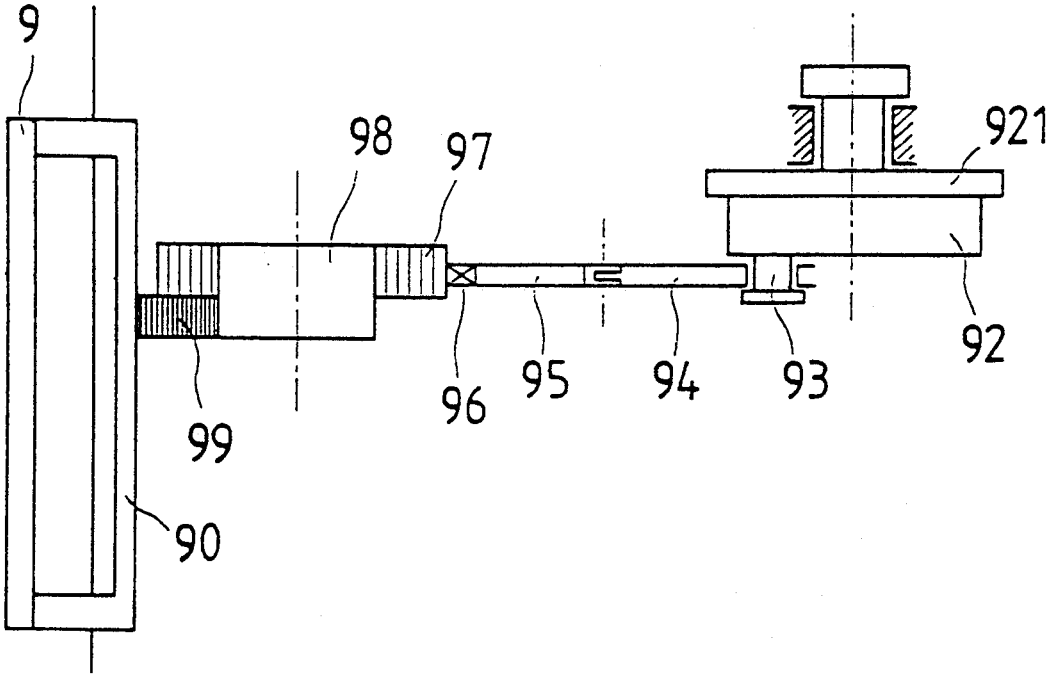
FIG. 9 is a plan view of FIG. 8.

Next, an in-and-out mechanism of a car stop 9 for preventing the wheelchair or the like from falling from the steps in a inclined traveling process of the escalator will be described with reference to FIGS. 8 and 9.

The in-and-out mechanism of the car stop is substantially on the same principle as the mechanism comprising the relationship between the reciprocating supporting members 65 and 66 and the transverse supporting members 81 and 82. Further, the in-and-out mechanism of the car stop 9 is arranged in the front floating step 11 or the rear floating step 31 in the same manner regardless of whether it is arranged in the former or the latter, so that the description will be made as to the in-and-out mechanism (shown in FIGS. 8 and 9) of the car stop 9 arranged in the rear floating step 31 that is used in the rising stroke of the oblique traveling. When a rack 91 provided on the floor side moves to the engaging position for the engagement with a pinion 92 arranged in the rear floating step 31, a crankshaft 93 attached to the pinion 92 will be rotated to reciprocate rod 95 through a connecting rod 94. The reciprocating rod 95 is connected to a detachable joint 96, the same as the joints 67 and 68 mentioned above, and the reciprocating rod 95 and a rack 97 are connected with each other by means of the detachable joint 96 for moving the rack 97 in the forward or rearward direction. Thus, when the rack 97 moves in the forward direction, a pinion 98 engaged with the rack 97 is caused to be rotated. This further causes the in-and-out operation of a car stop supporting member 90, which includes a rack 99 engaged with the pinion 98, to be carried out. The frame-shaped car stop 9 is combined with the car stop supporting member 90. In order to stop rotation of the crankshaft 93 by an angle of 180°, a click mechanism 921 is used.

Figure 10:
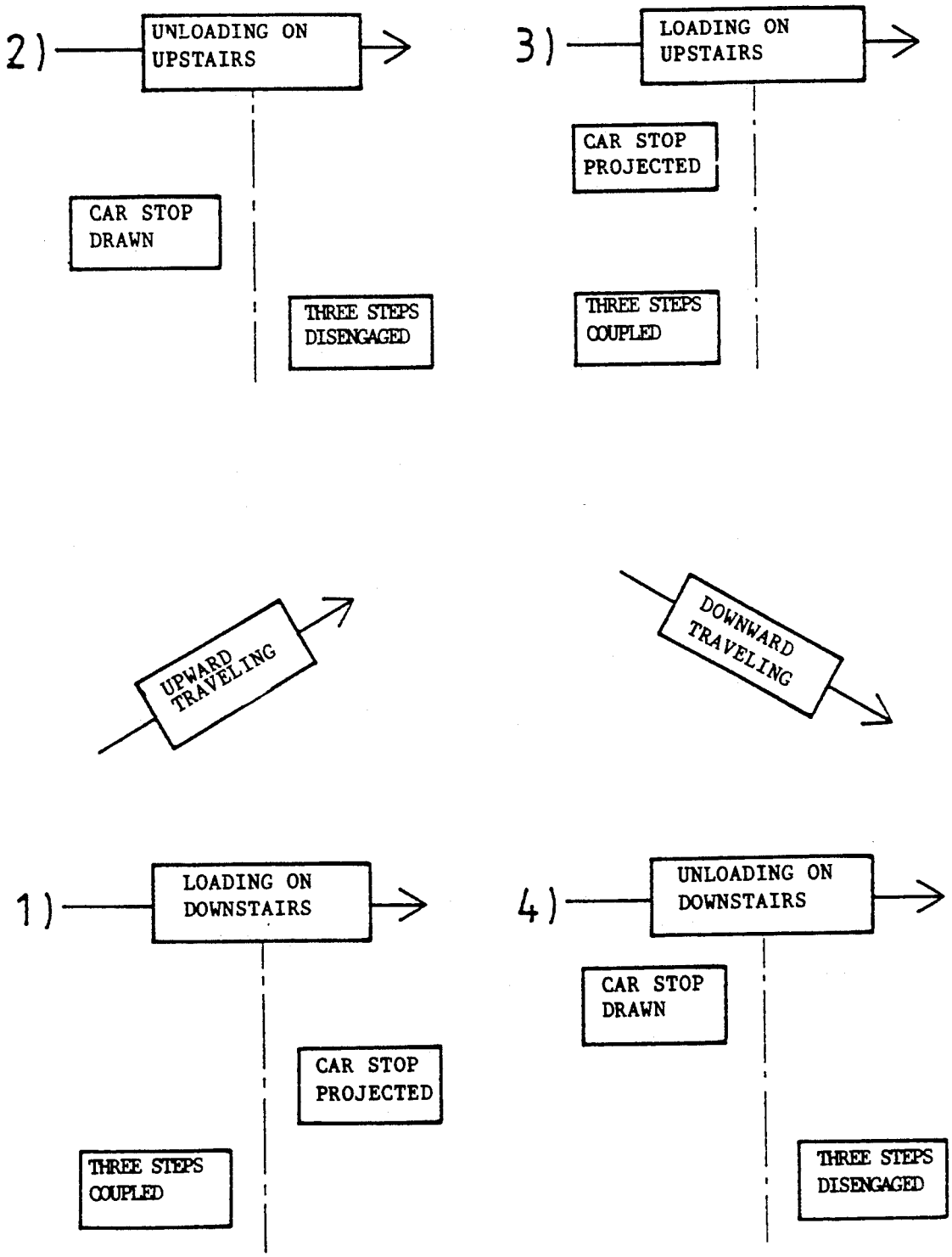

Next, an operation according to the present embodiment will be explained in steps 1) to 4) with reference to FIG. 10.

1) When loading the wheelchair on a downstair level travelling section (See FIG. 10 1)):

In the level travelling section, after a unit for loading the wheelchair has passed, the traveling speed of the escalator is decelerated. When the motor 51 is driven, the rack 5 is moved to the engaging position for engaging with the pinion 4. Then, when the pinion 4 coming along with the intermediate step 2 starts to engage with the rack 5, the reciprocating supporting members 65 and 66 advance by a stroke for connection to the detachable joints 67 and 68 within a crank angle ranging from 0° to 180° (at around an angle of 90°); the transverse supporting members 81 and 82 are separated from the engaging holes due to the function of the rack and pinion mechanism respectively; and as a result, the coupling of the front and rear floating steps 11 and 31 and that of the front and rear fixed steps 10 and 30 are released respectively. Moreover, the front and rear floating steps 11 and 31 are coupled with the intermediate step 2 by means of the reciprocating supporting members 65 and 66 and the detachable joints 67 and 68, whereby the formation of the steps for supporting the wheelchair is completed. When such a condition becomes available, travelling of the escalator is stopped for loading the wheelchair or the like on the steps. Before loading, however, the rack 91 for driving the car stop needs to be brought to the engaging position (the movement of the rack 91 may be simultaneous with the movement of the rack 5). When the travel of the escalator is resumed, the pinion 92 soon starts to engage with the rack 91 for driving the car stop to cause the car stop 9 to project; and the projection car stop 9 comes to an end when the crank 93 driven by means of the pinion 92 including the click mechanism has turned up to 180°, the escalator resumes travel.

2) When the wheelchair is unloaded on the upstair level travelling section (See FIG. 10 2)):

The rack 91 for driving the car stop is moved to the position where the engagement with the pinion 92 will take place. At the upstair level travelling portion where the escalator is coming upwardly coming, the rack 91 engages with pinion 92 before the escalator stops traveling, and when the crankshaft 93 is rotated by an angle of 180°, the car stop is completely drawn into the floating step 31.

Then, the traveling of the escalator is stopped, and the wheelchair is removed from the level section and the rack 5 is moved to the position where the engagement with the pinion 4 will take place. When the escalator device is driven again, the pinion 4 engages with the rack. Further, the front and rear floating steps 11 and 31 are coupled with the front and rear fixed steps 10 and 30 respectively, whereby the reciprocating supporting members 65 and 66 are received within the intermediate step 2; and the escalator device is made to travel under a normal condition.

3) When the wheelchair is loaded on the upstair level travelling section (See FIG. 10 3)):

In this case, the front step 1 comes under intermediate step 2 in an inclined downward travelling portion. Thus, the car stop 9 is provided in the front floating step 11. In this case, operations for supporting the front and rear floating steps 11 and 31 by the intermediate step 2 and for projecting the car stop 9 may be effected almost simultaneously. Thus, engagement of the rack 5 and the pinion 4 for driving the front and rear supporting members and that of the rack 91 and the pinion 92 for driving the car stop may be also effected simultaneously.

Incidentally, both the operations for disengaging the coupling of the front and rear floating steps 11 and 31 and the front and rear fixed steps 10 and 30 and for making the couplings of the front and rear floating steps 11 and 31 and intermediate step 2 are the same as those described in the foresaid item 1).

4) When the wheelchair is unloaded from the downstair level travelling portion (See FIG. 10 4)):

As mentioned above, the car stop 9 is drawn into the rear floating step 31 before the escalator stops traveling. The escalator is then stopped. Next, after the wheelchair is unloaded from the level section and the escalator starts to travel again, disengagement of the coupling of the intermediate step 2 and the front and rear floating steps 11 and 31 and coupling of the front and rear fixed steps 10 and 30 and the front and rear floating steps 11 and 31 simultaneously take place respectively.

Furthermore, in the normal travelling without loading the wheelchair or the like, each of the floating steps 11 and 31 moves while being coupled with the front or rear steps 10 or 30. The front floating step 11 and the front fixed step 10 and the rear floating step 31 and the rear fixed step 30 are integrally combined respectively as if they were moving as the section of the common escalator device.

Advantages of the present invention are as described below:

(1) Operations in which the floating steps are coupled with or separated from the fixed steps or the intermediate step are effected by using a driving source for driving the escalator device, so that the driving source can be utilized economically. Further, as mentioned in the above embodiment, the motor for moving the racks 5 and 91, which controls the change of coupling or disengagement of the steps, may be of a relatively small capacity, since such a motor is required to operate only the racks 5 and 91.

(2) Principal movement is mainly accomplished by a mechanical system, so that a simple controller combined with a sensor for detecting stop position is good enough in controlling the entire travelling of the escalator.

I claim:

1. An escalator device comprising:

a set of three serial steps consisting of an intermediate step, a front step and rear step, of which each of the front step and the rear step is divided into a fixed step and floating step;

a first coupling means for coupling the intermediate step to each of the floating steps, a second coupling means for coupling the floating steps and the corresponding fixed steps; and a means for associating the first coupling means and the second coupling means with each other, wherein the second coupling means functions as a changing means for releasing the coupling of the respective floating steps and the corresponding fixed steps when the intermediate step is coupled with the respective floating steps by the first coupling means.

2. An escalator device according to claim 1, wherein the first coupling means includes reciprocating supporting members for coupling the intermediate step and each of the floating steps, said reciprocating supporting members being adapted to be extended in front and rear directions and horizontal or upwardly inclined directions from the intermediate step; said reciprocating supporting members further being adapted to be inserted in each of the front and rear floating steps, whereas the second coupling means includes transverse supporting members which are adapted to be inserted into each of fixed steps corresponding to each of the floating steps.

3. An escalator device according to claim 2, wherein the changing means, includes a first pinion arranged in the intermediate step, a first rack adapted to be movable to a position for engaging with the first pinion on a floor where steps of the escalator device become level, a crank mechanism for moving the reciprocating supporting means by a rotation of the first pinion, a mechanism for starting and stopping the rotation of a crankshaft by a rotational angle of 180° in association with engagement of the first rack and first pinion, and a second pinion and rack mechanism for moving the transverse supporting members in association with movement of the reciprocating supporting members.

4. An escalator device according to claim 1, wherein a car stop is arranged in one of said floating steps and means are provided for moving said car stop to a position extending upwardly from said one floating step when said floating steps are coupled to said intermediate step.

* * * * *

UNITED STATES PATENT AND TRADEMARK OFFICE

CERTIFICATE OF CORRECTION

PATENT NO. : 5,295,569

DATED : MARCH 22, 1994

INVENTOR(S) : MASAO KUBOTA

It is certified that error appears in the above-indentified patent and that said Letters Patent is hereby corrected as shown below:

Col. 1, line 17, "is enough" should be --is not enough--;
line 34, "of a usual" should be --of usual--;
line 35, "forms step" should be --forms a step--.

Col. 2, line 18, "which positioned" should be --which is positioned--;
line 39, "which positioned" should be --which is positioned--.

Col. 4, line 5, "mechanism" should be --mechanisms--;
line 64, "85 and 85" should be --85 and 86--.

Col. 5, line 27, "lever" should be --levers--.

Col. 6, line 56, "coming" (second occurrence) should be deleted.

Signed and Sealed this

Eighth Day of November, 1994

Bruce Lehman

*Attest:*

BRUCE LEHMAN

*Attesting Officer*

*Commissioner of Patents and Trademarks*